United States Patent [19]

Duret

[11] Patent Number: 4,917,073

[45] Date of Patent: Apr. 17, 1990

[54] TWO STROKE ENGINE AND METHOD OF DESIGNING SAME

[75] Inventor: Pierre Duret, Paris, France

[73] Assignee: Institut Francais du Petrole, Rueil Malmaison, France

[21] Appl. No.: 195,795

[22] Filed: May 19, 1988

[30] Foreign Application Priority Data

May 19, 1987 [FR] France ..... 87 7023

[51] Int. Cl.[4] ..... F02B 33/04

[52] U.S. Cl. ..... 123/73 C; 123/65 VB

[58] Field of Search ..... 123/73 C, 65 VB, 65 A

[56] References Cited

U.S. PATENT DOCUMENTS 2,763,248 9/1956 Green et al. ..... 123/65 VB

FOREIGN PATENT DOCUMENTS 510959 1/1955 Italy ..... 123/73 C

*Primary Examiner*—Noah P. Kamen

*Attorney, Agent, or Firm*—Antonelli, Terry & Wands

[57] ABSTRACT

An internal combustion 2-stroke engine having at least one combustion chamber equipped with a delayed fuel supply system opening into a cylinder head. A wall of the cylinder has at least one exhaust port situated in the vicinity of a first referernce point through which passes a first axial plane of the cylinder or exhaust plane and at least one intake port situated in the vicinity of a second reference point, or intake reference point. A plane perpendicular to the exhaust plane and containing the axis of the cylinder defines two accommodation zones in the cylinder with the first accommodation zone, complementary to the second one, containing the reference point of the exhaust port, and the supply system is situated in the second accommodation zone.

19 Claims, 5 Drawing Sheets

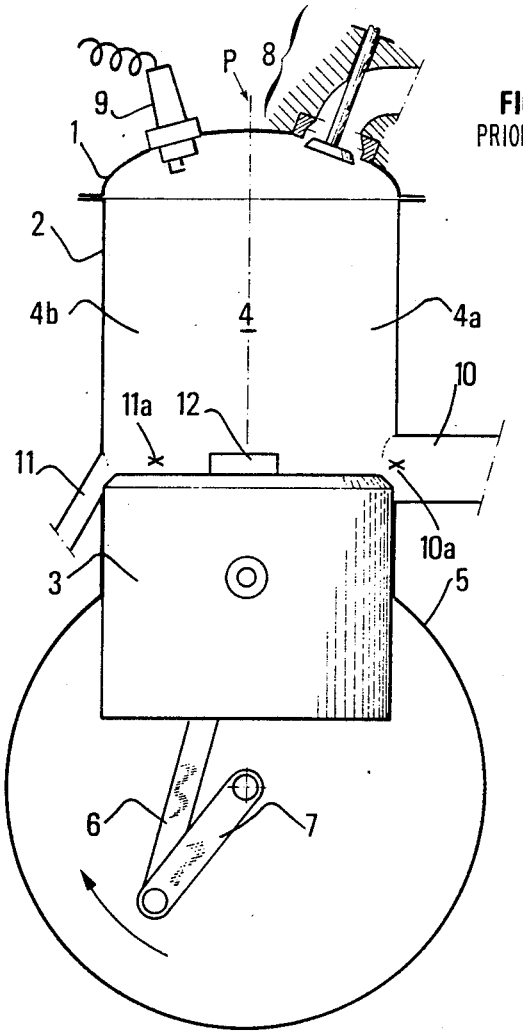
FIG.1
PRIOR ART
FIG.2
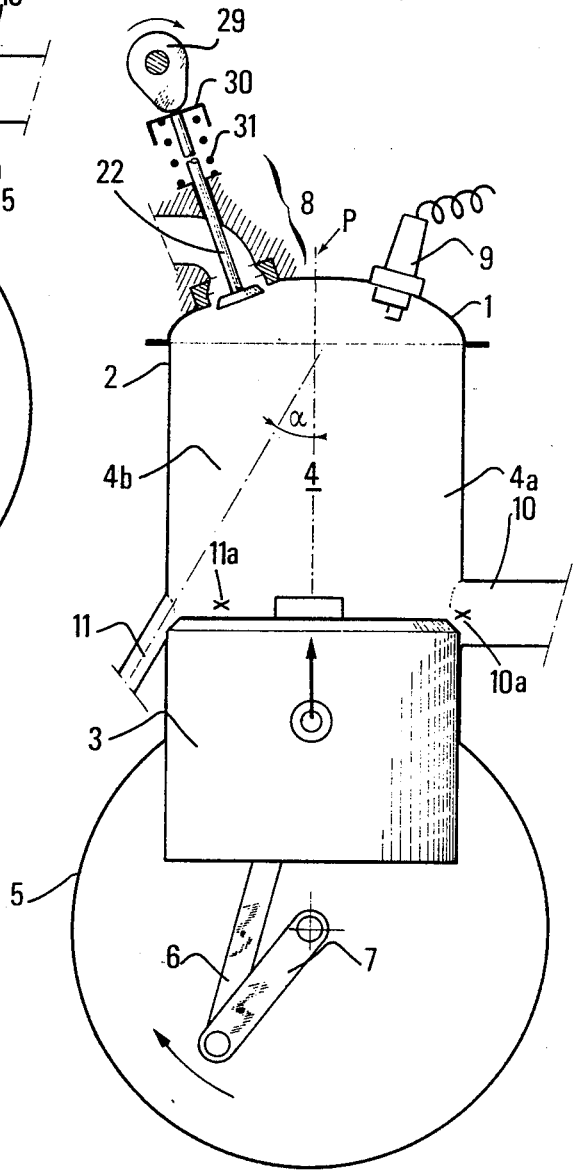

TWO STROKE ENGINE AND METHOD OF DESIGNING SAME

BACKGROUND OF THE INVENTION

The present invention relates to a method and an arrangement of the different members inside a combustion chamber of an internal combustion 2-stroke engine.

More particularly, the invention relates to 2-stroke engine combustion chambers comprising intake and exhaust ports and a delayed fuel supply system placed at the level of the cylinder head.

The study of the combustion of a 2-stroke engine has revealed the importance of the conditions in which the combustion is initiated for obtaining correct and complete combustion of supplied.

Such initiation of the combustion depends essentially on the internal aerodynamics and on the conditions prevailing in the neighbourhood of the ignition point, particularly in so far as the richness of the mixture is concerned in the vicinity of this point.

Complete combustion of the fuel introduced depends more particularly on the amount of fuel introduced which remains in the chamber for combustion.

In facet, in engines where the fuel is introduced before the exhaust port is closed, a certain portion of the fuel may escape into the exhaust without being combusted in the combustion chamber thereby resulting in considerable consumption and pollution by the engine.

This drawback is particularly acute in engines admitting carburetted air for scavenging the combusted gases. In addition, the use of a non-carburetted fresh air intake for scavenging the combusted gases, combined with a delayed fuel supply system initiated once the fresh air has been introduced into the chamber, would be able to prevent the escape of uncombusted fuel, if it were not indispensable for the combustion (particularly in so far as the homogenization of the fuel mixture is concerned) to introduce the fuel before the exhaust is closed, with the risk of losing a portion of the fuel.

The delayed fuel supply system may comprise either an injector emerging directly or indirectly into the combustion chamber and controlled, for example, electronically or by a cam as a function of the rotation of the crank shaft, or else a pneumatic injector, such as described, for example, in Patent FR-A-2.575.521.

In a 2-stroke engine comprising a pneumatic injector placed in the cylinder head, the respective positions of the pneumatic injector and of the ignition point in the combustion chamber represent important parameters for the internal aerodynamics and so of the combustion initiation conditions.

With the main purpose of reducing the uncombusted gases and improving the combustion initiation conditions, and so combustion, the present invention provides different arrangements of the combustion chamber.

The arrangements provided in accordance with the invention have been studied theoretically and experimentally, more particularly by digital simulation and tests on engines.

SUMMARY OF THE INVENTION

For 2-stroke engines equipped with a pneumatic fuel injector in the cylinder head, the arrangements devised and chosen for their interest are characterized in that the ignition point is placed on the exhaust side, or else the pneumatic injector is placed on the side opposite the exhaust, or else the pneumatic fuel injector is installed on the same side as the rear intake port, such as rear transfer ports.

Fortunately, for the manufacturing of engines, these arrangement conditions are compatible with a simple architecture of the engine.

Thus, the present invention relates to a 2-stroke internal combustion engine having at least one combustion chamber equipped with a delayed fuel supply system feeding into a cylinder head which covers a cylinder incorporating with a piston, the cylinder head, the cylinder and the piston difining the combustion chamber. The wall of the cylinder comprising at least one exhaust port situated in the vicinity of a first reference point through which passes a first axial plane of the cylinder or exhaust plane and at least one intake port situated in the vicinity of a second reference point, or intake reference point.

The internal combustion engine of the present invention is characterized particularly in that the plane perpendicular to the exhaust plane and containing the axis of the cylinder defines two accommodation zones in the cylinder, the first of which, complementary to the second one, contains the reference point of the exhaust port and the supply system is situated in the second accommodation zone.

The cylinder head may comprise a spark plug which may be situated in the first accommodation zone.

The intake reference point may be situated in the second zone. The supply system may be adapted to produce a convergent jet in the second accommodation zone oriented substantially towards the intake reference point.

The supply system may be adapted to produce a divergent jet which passes through said second accommodation zone and is oriented towards the intake reference point and which is also directed towards the first accommodation zone in the vicinity of the cylinder head.

The supply system may be a pneumatic injection system and comprise a deflector adapted for modifying the shape of the jet. The pneumatic injection system which produces the jet of carburetted gas may comprise a valve. Controlled by an electromagnetic system such as, for example as a solenoid. The valve may be controlled automatically by the upstream and downstream pressure of the gases and, if required, a return means, such as a spring, or be controlled mechanically from a cinematic chain connected to the crank shaft, with the chain, possibly comprising guide Pinions, cam shaft, etc. The injection system may comprise a rotating throttle chamber.

The supply system may be adapted for producing a divergent jet in the perpendicular plane.

The supply system may be adapted for producing a jet oriented substantially counter-currentwise to the gas scavenging loop or loops.

The intake port may be a transfer port and so be connected to the casing of the cylinder.

The intake port may be connected to an upwardly inclined duct. Thus, the fluid coming from this port will be oriented towards the cylinder head. Furthermore, the present invention provides a method of designing an internal combustion 2-stroke engine having at least one combustion chamber equipped with a delayed fuel supply system, the chamber being defined by a cylinder head, a cylinder and a piston, the wall of the cylinder comprising at least one exhaust port situated in the vicinity of a first reference point and at least one intake port situated in the vicinity of a second reference point or intake reference point.

This method is more particularly characterized in that the arrangement and the shapes of at least one intake port are adapted so as to produce a fresh gas current directed initially substantially towards the supply system, and in that the supply is placed as close as possible to the intake reference point, following the fresh gas stream.

BRIEF DESCRIPTION OF THE DRAWINGS

The invention will be well understand and all its advantages will be clear from the following description when taken in connection with, the accompanying drawings in which:

FIG. 1 is a schematic partial cross-sectional view of an arrangement of an engine in accordance with the prior art;

FIG. 2 is a schematic partial cross-sectional view of a first arrangement of an engine in accordance with the present invention;

DESCRIPTION OF THE PREFERRED EMBODIMENTS

Figure 3A:
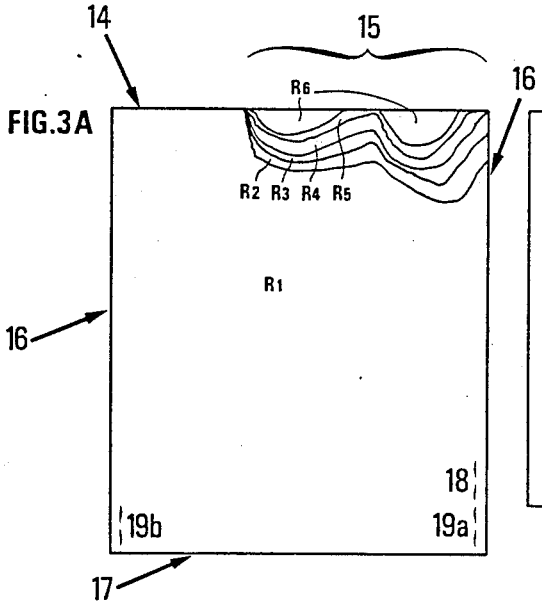
FIGS. 3A–3F respectively depict fuel isoconcentrations obtained by digital simulation for an arrangement of the prior art engine of FIG. 1 during a movement of the piston of the engine.

As shown in FIG. 1, a prior art engine, includes cylinder head 1 closing an upper part of cylinder 2 defining a combustion chamber 4 inside which a piston 3 moves connected by a connecting rod 6 to a crankshaft 7 disposed in a crankcase 5.

The cylinder head 1 comprises a spark plug 9 for creating an ignition point by an electric arc and a delayed fuel supply system, with the exhaust communicating with the cylinder 2 through an exhaust port 10 8 which may be a pneumatic injection system.

The exhaust communications with cylinder 2 through a port 10.

The intake communicates with the cylinder 2 through a rear intake port 11 and through one or more side intake ports 12. All these ports may comprise one or more orifices.

Cylinder 2, like piston 3 sliding therein, are assumed to be a revolution about an axis P, as in practice. Still within the scope of the invention, cylinder and piston forms may be used substantially different from those of revolution.

Considering that the exhaust port 10 is situated about a first reference point 10*a*, and that the exhaust plane contains this point and the axis of the cylinder, the plane perpendicular to the exhaust plane passing through the axis of the cylinder defines, in the combustion chamber, two separate accomodation zones 4*a*, 4*b*, the first accomodation zone for a 4*a*, complementary to the second accommodation zone 4*b*, contains the reference point 10*a* of the exhaust port 10.

In the prior art (FIG. 1) the fuel supply system 8 is situated in the first accommodation zone 4*a*, namely on the same side as the reference point 10*a* of the exhaust port 10 with respect to the perpendicular plane.

Similarly, the second reference point 11*a*, or intake reference point, about which the rear intake port 11 and side intake port 12 are situated, is situated in the second accommodation zone 4*b* with plug 9, whereas, the fuel supply system 8 is situated in the first accommodation zone 4*a*.

According to the invention (FIG. 2), the intake reference point 11*a* as well as the fuel supply system 8 is situated in the second accommodation zone, 4*b* namely on the side opposite the reference point 10*a* of the exhaust port, 10 with respect to the perpendicular plane whose axis P is the front trace in the plane of FIG. 2. Finally, spark plug 9 is situated in the first accommodation zone 4*a*.

The fuel supply system 8 only delivers the fuel when piston 3 is in the rising phase. Thus, the injection valve 22 only opens after the piston 3 has reached the bottom dead center.

The positions of the intake ports 11 and/or 12 like those of the exhaust ports 10 are given from, respectively, the first reference point and the second reference point about which the ports are situated.

The reference points correspond substantially to the application points of the vertical resultants of the speeds of the gases at the intake and exhaust ports.

However, since it is difficult to obtain the resultants, it may often be considered that the reference point corresponds to the barycenter of the areas of the intake and exhaust ports.

Thus, when an exhaust system comprises two ports, the exhaust reference point is situated between the two ports or else the ports are situated about the exhaust reference point.

In the present invention, the intake ports may be advantageously transfer ports and so be connected to the pump-case of the engine.

In addition, in accordance with the present invention, the intake port duct 11 forms advantageously, where it emerges into the combustion chamber 4, an angle $\alpha$ less than 90°, with the angle $\alpha$ being defined by the longitude center axis of duct the intake port 11 and the axis of the cylinder 2. Thus, the intake port 11 is aimed at the cylinder 2 in the direction of the cylinder head 1.

Advantageously, the angle $\alpha$ may be between 30° and 45°, so that the fluid leaving is directed towards the cylinder head 1.

FIGS. 3A to 3F and 4A to 4F illustrate the fuel concentration variations appearing in a combustion chamber 4 during rotation of the crankshaft 7. These figures have been obtained by a two-dimensional model of a combustion chamber taking into account the interaction of the scavenging loop formed by the fresh gas mass taken in through the intake port 11 and/or 12, with the jet of the pneumatic injector 8.

The upper straight line segment 14 in the figures illustrate the cylinder head 1, whereas, location 15 corresponds to the fuel supply zone. The vertical straight line segments 16 represent the walls of the cylinder 2 and the lower straight line segment 17 represents the piston.

So that the model reproduces as correctly as possible the behaviour of the gases inside the combustion chamber 4, particularly in so far as the scavenging is concerned, it is considered that the intake takes place through two ports symbolized by zones 19*a* and 19*b* and that the exhaust takes place through a port symbolized by the zone 18.

The intake ports open at 55° before bottom dead center and close 55° after bottom dead center (namely respectively 125° and 235° of crankshaft angle).

The exhaust port opens at 71° before bottom dead center and closes at 71° after bottom dead center (namely respectively 109° and 251° of crankshaft angle).

A first intake 19*a* feeding air at an initial angle of zero degrees with respect to the horizontal is placed opposite a second intake port 19*b* feeding air at an initial angle of 60° with respect to the horizontal. The intake port 18 is placed above the first intake 19*a*.

With the fuel concentration being the mass of fuel relative to the mass of the fresh air, combusted gas and fuel mixture, the isoconcentration lines define richness ranges comprising references corresponding to the following values of the fuel concentration:

| Reference of the zone | Fuel concentration range |
|---|---|
| R1 | less than 0.01 |
| R2 | between 0.01 and 0.02 |
| R3 | between 0.02 and 0.03 |
| R4 | between 0.03 and 0.05 |
| R5 | between 0.05 and 0.075 |
| R6 | more than 0.075 |

FIGS. 3A to 3F illustrate the model of a combustion chamber conforming substantially to that of FIG. 1.

The different figures have been produced for different angles of the crankshaft corresponding to the following indications:

| FIG. | Crankshaft angle |
|---|---|
| 3A | 213° |
| 3B | 235° |
| 3C | 251° |
| 3D | 277° |
| 3E | 303° |
| 3F | 330° |

For FIGS. (3A to 3F), the supply system comprises a deflector for giving an initial direction to the jet inclined by 20° with respect to the axis of the cylinder towards the rear intake port.

The model of FIGS. 3A to 3F shows that the jet keeps its initial direction for very little time and that very rapidly it is deflected towards the exhaust by the scavenging loop which is driven by a substantially giratory movement, in a clockwide direction, in the figures.

Figure 3B:
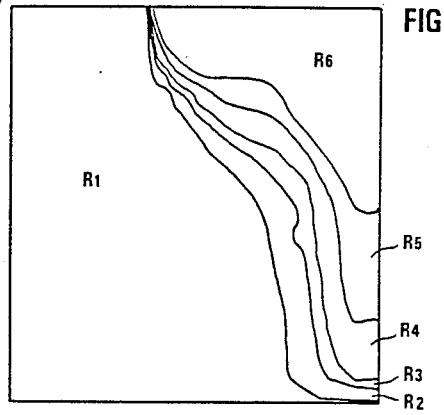
Figure 3C:
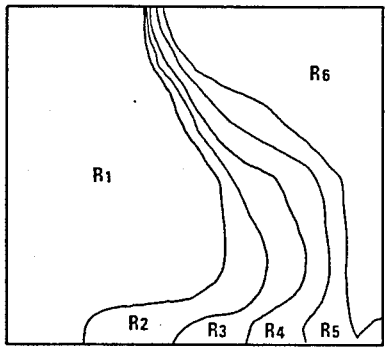
Figure 3D:
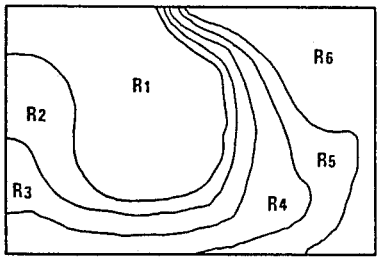
Figure 3E:
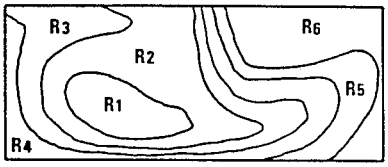
Figure 3F:
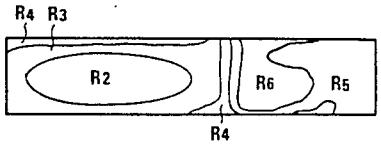

FIG. 3F which shows the isoconcentrations in the chamber when the crankshaft angle is 330° (namely at the time when ignition occurs), shows that the interaction of the pneumatic jet with the scanning loop has generated a fuel richer zone on the exhaust side where the pneumatic injector is also situated. However, the sparkplug, for architectural considerations difficult to comply with, cannot be on the rich side and is placed on the opposite side.

This result well illustrates the experimental observations made on an engine of similar configuration which becomes unstable, particularly at high speeds. Such a manifestation confirms perfectly with the poor combustion conditions.

With FIG. 3C showing the chamber at the time when the exhaust port closes, it can be understood, also with the aid of FIG. 3B, that a portion of the fuel leaves directly through the exhaust. Calculations on the model set at 8% the losses through unburnt gases for the engine configuration studied.

FIGS. 4A to 4F illustrate the model of a combustion chamber of the invention conforming substantially to that of FIG. 2 and in which the supply system comprises a deflector for giving to the jet an initial direction inclined by 20° with respect to the axis of the cylinder towards the exhaust port.

The different figures have been produced for different crankshaft angles corresponding to the following indications:

| FIG. | Crankshaft angle |
|---|---|
| 4A | 211° |
| 4B | 235° |
| 4C | 251° |
| 4D | 271° |
| 4E | 310° |
| 4F | 330° |

It can be observed with the model shown in FIGS. 4A to 4F, as before, that the fuel jet kept its initial direction for very little time and that it was deflected towards exhaust by the scavenging flowing as in the prior engines.

Figure 4A:
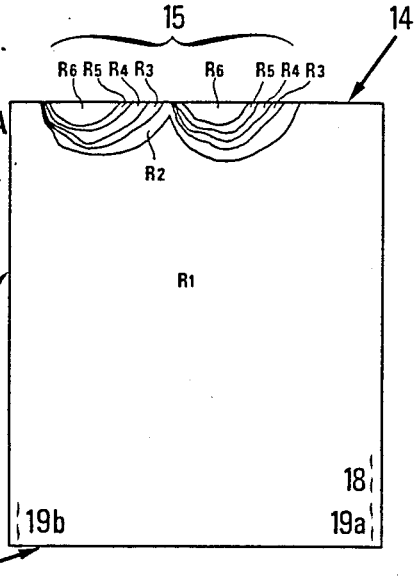
FIGS. 4A–4F respectively depict fuel isoconcentrations obtained by a digital simulation for the arrangement of an engine in accordance with the invention of FIG. 2 during a movement of the piston.
Figure 4B:
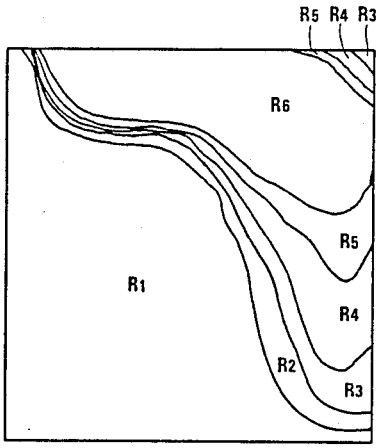
Figure 4C:
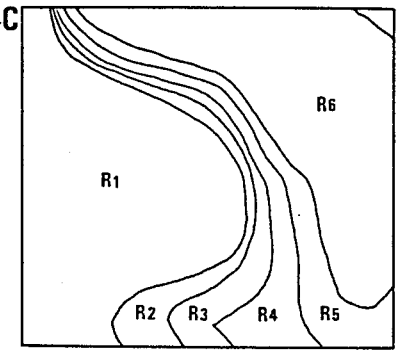
Figure 4D:
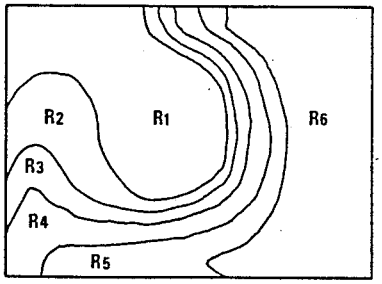
Figure 4E:
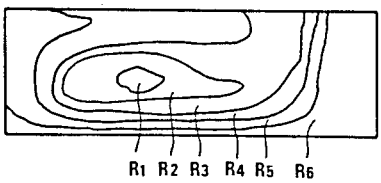
Figure 4F:
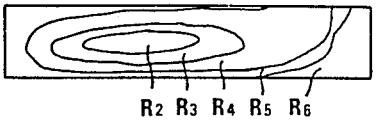

The different figures show that with the configuration of the invention, the rich zones take longer to reach the exhaust because of the length of path to be travelled over between the supply system and exhaust, that they spread better through the chamber and that finally the gas mixture is generally more uniform when the ignition occurs (FIG. 4F).

Calculations on models, for this engine configuration, set at 4% the losses through uncombusted gases.

Furthermore, the sparkplug placed on the exhaust side is situated in a rather richer zone where excellent combustion initiation may take place. This result is confirmed experimentally on an engine where operating speeds were reached without any particular manifestation of combustion instability.

Figure 5:
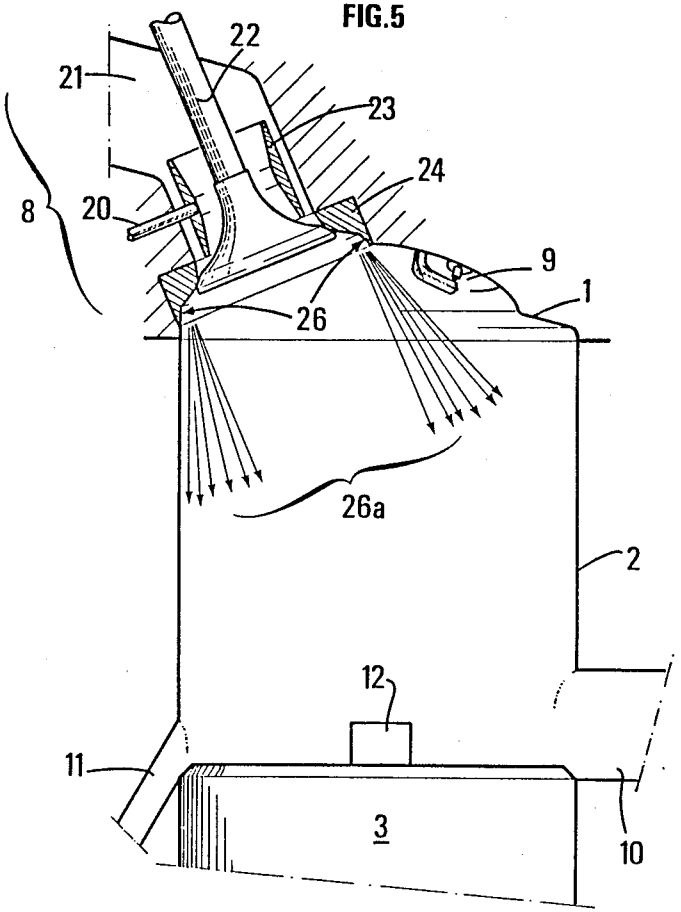
FIG. 5 is a schematic partial cross-sectional view of a second arrangement of an engine in accordance with the present invention using a divergent deflector.
Figure 6:
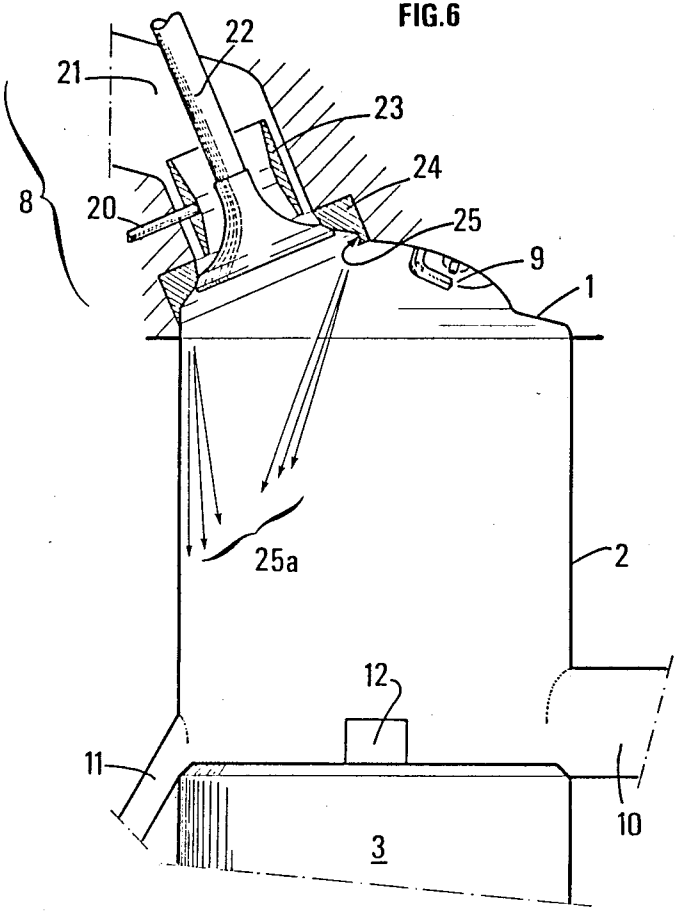
FIG. 6 is a schematic partial cross-sectional view of a third arrangement of an engine in accordance with the present invention using a convergent deflector.
Figure 7:
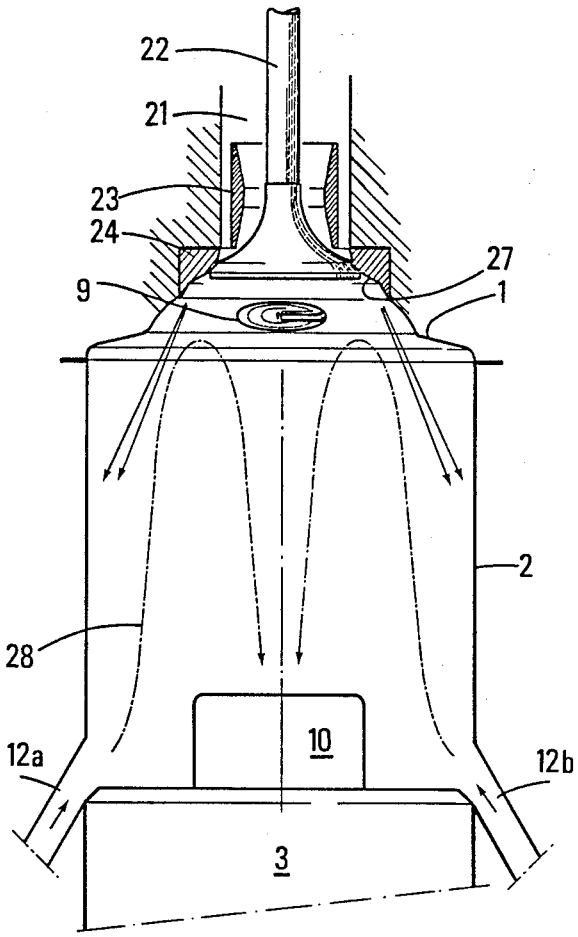
FIG. 7 is a schematic partial cross-sectional view of a plane perpendicular to a sectional plane of FIGS. 1, 2, 5 and 6, of one arrangement of an engine in accordance with the present invention using a divergent deflector in a perpendicular plane.

FIGS. 5, 6 and 7 show the importance of the direction of the initial jets coming from the supply system 8.

In the embodiments, of FIGS. 5-7 a pneumatic injector 8 is used such as the one described in patent FR-A-2.575.522.

A member 20 injects fuel into the nozzle 23 placed in a compressed air stream. An injection valve 22 bearing on a seat 24 isolates the injection system 8 from the combustion chamber 3 when the compression pressure has reached a certain threshold.

The system comprises deflectors 25, 26, 27 integrated in the seat for modifying the initial incidence of the jet.

The deflectors make it possible to create conditions very favorable to combustion initiation and to slow down the travel of the pneumatic fuel jet towards the exhaust port, so as to reduce the amounts of unburnt fuel.

Thus, in FIG. 5, a divergent deflector 26 has been used slowing down the penetration of the pneumatic jet. A portion of this jet 26 is directed towards the face of the cylinder 2 nearest to the injection system 8 so as to reduce, by opposing it, the entrainment of the scavenging loop.

FIG. 6 illustrates an engine comprising a counter-current deflector for, on the one hand, increasing the path followed by the scavenging loop so as to avoid the losses of uncombusted gases to the exhaust and, on the other hand, for keeping a part of the jet along the wall of the cylinder, 2 the closest to the injection system.

FIG. 7 shows schematically a combustion chamber comprising a deflector 27 diverging in a plane parallel to said perpendicular plane. With this arrangement, the penetration of the pneumatic fuel jets can be slowed down in this plane parallel to the perpendicular plane, so as to reduce the losses through uncombusted gases.

Valve 22 may be controlled in several ways. In the case of FIG. 2, the valve 22 is controlled electrically, for example, by a cam 29 rotated at the speed of the engine. This cam 29 controls the movement of valve 22 through a push-rod 30 and the valve 22 is returned by a spring 31.

Reference numerals 35 and 36 designate respectively a fuel control device and a venturi nozzle with reference numeral 37 designating a deflector.

Figure 8:
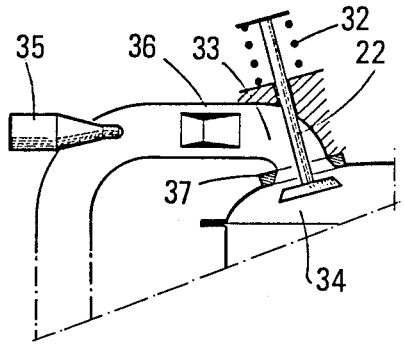
FIG. 8 is a schematic partial cross-sectional view of a detail of a supply system comprising a valve controlled automatically by a pressure difference prevailing on each side of a widened-out portion.

In the particular case of FIG. 8 which illustrates another variant, the valve 22 does not have a control system in the proper meaning of the term. It may be simply equipped with a return spring 32. It is left free to move as a function of the upstream 33 and downstream 34 pressure differences. It then acts in the manner of an automatic valve, it would be said to be controlled automatically. The calibration of spring 32 is provided so as to obtain the appropriate opening movements of the valve.

Figure 9:
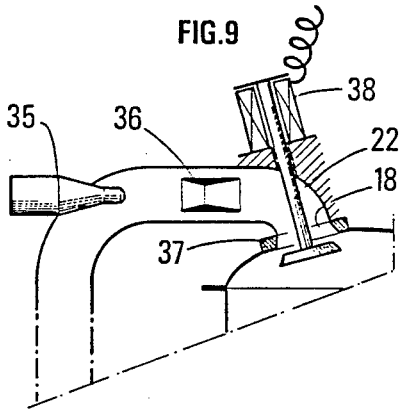
FIG. 9 is a schematic partial cross-sectional view of a detail of a supply system comprising a electro-magnetically controlled solenoid valve.

In FIG. 9, the valve 22 is controlled by a solenoid 38. This solenoid 38 may be controlled electronically so as to cause valve 22 to open at the most appropriate moment.

Figure 10:
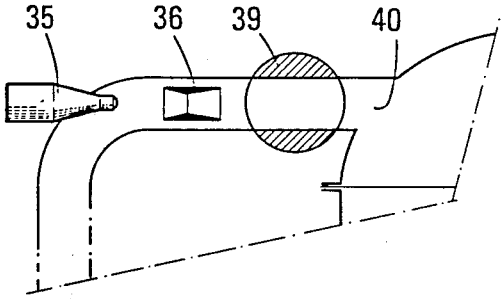
FIG. 10 is a schematic partial cross-sectional view of a detail of a supply system comprising a rotary valve.

FIG. 10 shows a supply system comprising a rotary valve 39 driven by rotation of the engine and which thus controls opening of the orifice 40 through which the jet comprising the fuel penetrates into the cylinder 2.

What is claimed is:

1. An internal combustion two-stroke engine comprising at least one combustion chamber, a delayed pneumatic fuel injection system for producing a caburetted gas jet opening into a cylinder head means covering a cylinder cooperating with a piston mean, the cylinder head means, the cylinder and the piston means defining said at least one combustion chamber, a wall of the cylinder comprising at least one exhaust port disposed in a vicinity of a first reference point through which passes a first axial plane of the cylinder or an exhaust plane, and at least one intake port situated in a vicinity of a second reference point or an intake reference point, wherein a plane perpendicular to the exhaust plane and containing a longitudinal center axis of the cylinder defines two accommodation zones in the cylinder, a first of said two accommodation zones, complementary to a second of the two accommodation zones, contains the reference point of the exhaust port, and wherein the pneumatic fuel injection system is disposed in said second of said two accommodation zones.

2. The engine as claimed in claim 1, wherein said cylinder head comprises a spark plug disposed in said first of said two accommodation zones.

3. The engine as claimed in one of claims 1 or 2, wherein said intake reference point is disposed in said second of said two accommodation zones.

4. The engine as claimed in claim 3, wherein said pneumatic fuel injection system produces a convergent jet in said second of said two accommodation zones oriented substantially towards said intake reference point.

5. The engine as claimed in claim 3, wherein said pneumatic fuel injection system produces a divergent jet passing through said second of said two accommodation zones and is oriented towards said intake reference point and directed towards said first of said two accommodation zones in a vicinity of the cylinder head means.

6. The engine as claimed in claim 1, wherein return means are provided for returning said valve means to a closed position.

7. The engine as claimed in claim 1, wherein said pneumatic injection system comprises a valve means and a deflector means for modifying a form of said gas jet.

8. The engine as claimed in claim 7, wherein an electromagnetic system controls a positioning of said valve means.

9. The engine as claimed in claim 8, wherein said electromagnetic system includes a solenoid means for actuating said valve means.

10. The engine as claimed in claim 7, wherein said valve means is controlled mechanically from a kinematic chain means connected to a crankshaft means of the engine.

11. The engine as claimed in claim 7, wherein said valve means is automatically controlled by an upstream and a downstream pressure of the gases acting thereon.

12. The engine as claimed in claim 1, wherein said pneumatic fuel injection system comprises a rotary valve means.

13. The engine as claimed in claim 1, wherein said pneumatic fuel injection system produces a divergent carburetted jet of gas in said perpendicular plane.

14. The engine as claimed in claim 1, wherein said pneumatic fuel system produces a carburetted jet of gas oriented substantially counter-currentwise with respect to at least one gas scavenging loop.

15. The engine as claimed in claim 1, wherein said intake port is a transfer port connected to a crankcase means of the engine.

16. The engine as claimed in claim 1, wherein said intake port is connected to an upwardly inclined conduit means.

17. The engine as claimed in claim 1, wherein said pneumatic fuel injection system produces a divergent jet passing thrugh said second of said two accommodation zones and is oriented towards said intake reference point and directed towards said first of said two accommodation zones in a vicinity of the cylinder head.

18. The engine is claimed in claim 1, wherein said pneumatic fuel injection system produces a convergent jet in said second of said two accommodation zones oriented substantially towards said intake reference point.

19. A method of designing an internal combustion two-stroke engine having at least one combustion chamber defined by a cylinder head,-a cylinder and a piston, the method comprising the steps of providing a delayed pneumatic fuel injection system for producing a carburetted gas jet, providing at least one exhaust port in a vicinity of a first reference point, providing at least one intake port in a second reference point or intake reference point, arranging said at least one intake port so as to produce a fresh gas stream directed initially substantially towards the pneumatic fuel injection system, and disposing said pneumatic fuel injection system in said cylinder head at a position in close proximity to said intake reference point in a direction of flow of the fresh gas stream.

* * * * *